US010858882B2

(12) United States Patent
Otoski

(10) Patent No.: US 10,858,882 B2
(45) Date of Patent: Dec. 8, 2020

(54) VEHICLE PROTECTION SYSTEM

(71) Applicant: Patrick Archibald, Salem, MA (US)

(72) Inventor: Peter Otoski, Clearwater, FL (US)

( * ) Notice: Subject to any disclaimer, the term of this patent is extended or adjusted under 35 U.S.C. 154(b) by 97 days.

(21) Appl. No.: 16/223,758

(22) Filed: Dec. 18, 2018

(65) Prior Publication Data

US 2020/0190898 A1 Jun. 18, 2020

(51) Int. Cl.
*E06B 7/28* (2006.01)

(52) U.S. Cl.
CPC ..... *E06B 7/28* (2013.01); *E05Y 2900/106* (2013.01)

(58) Field of Classification Search
CPC ..... E06B 7/28; E05Y 2900/106; E05F 15/41; E05F 15/668
See application file for complete search history.

(56) References Cited

U.S. PATENT DOCUMENTS 4,241,540 A * 12/1980 Depperman ..... E05F 15/673 49/199
4,734,076 A * 3/1988 Goldstein ..... A63H 17/44 446/4
6,112,478 A 9/2000 Piper
6,240,681 B1 6/2001 Lyles et al.
6,945,191 B2 9/2005 Collopy
7,365,635 B2 * 4/2008 Oberhauser ..... E05F 15/76 340/5.26
9,650,827 B2 * 5/2017 Beeson ..... E06B 7/28
2007/0235149 A1 * 10/2007 Hillar ..... E05F 15/686 160/188
2008/0047672 A1 * 2/2008 Gorman ..... E05F 15/684 160/1
2009/0249695 A1 * 10/2009 Jain ..... E05F 15/668 49/148

* cited by examiner

*Primary Examiner* — Michael C Zarroli

(57) ABSTRACT

The present invention includes a system for protect a vehicle from damage. Specifically, a non-marking protector is attached to a garage door arm to prevent damage that may occur when the rear lift hatch of a vehicle is opened and makes contact with the garage door arm. The rear lift hatch will contact one or more non-marking protectors instead, thereby ensuring no damage is caused.

2 Claims, 6 Drawing Sheets

VEHICLE PROTECTION SYSTEM

BACKGROUND

1. Field of the Invention

The present general inventive concept relates generally to a vehicle protection system, and more particularly to a system that allows a user to safely open the rear lift hatch, or similar, of a vehicle housed within a garage, without damaging any portion of the vehicle.

2. Description of the Invention

All manner of vehicles, and especially automobiles used for personal and/or business use, have been increasing in size in recent years. One reason for this is the notion that a larger vehicle is safer should a crash or accident occur. More material means more impact absorbing capability, and car manufacturers have seized on this idea in their marketing campaigns throughout the world.

Additionally, in the United States, Americans have been getting larger as well. Obesity is an epidemic, but owners often choose to upsize their surroundings for reasons of comfort. Therefore, vehicle known as Sport Utility Vehicles (SUV) have become increasing popular for the rotund and portly.

Also, a large vehicle often costs more than a smaller one, and may therefore be seen as a status symbol amongst drivers. "Keeping up with the Jones" has never been more apparent than the large vehicles gracing the streets and cruising along the highways of America.

Not surprisingly, this substantial investment calls for substantial protection. Most vehicle owners prefer to house their vehicles within garages, protected from the elements, vandals, and wildlife. However, unless a garage is of recent construction, it very likely has not kept abreast of the increasing size of the vehicles housed within. Secure garage doors, automatic openers, security systems and alarms fail to alleviate the close quarters that many vehicles are now subjected to. More specifically, the majority of garage door openers include an inherent hazard that many vehicle owners are unaware of, while others are all too painfully aware.

Reference is now made to the rear lift hatch of these vehicles. Many vehicles today, and this is not limited to SUVs only, include a rear lift hatch that opens from the bottom and lifts upwards in an arcing motion. The result is that when these vehicles are inside the garage, and the owner makes his or her way to the rear of the vehicle to remove groceries, parcels or the like, and opens the rear lift hatch, the hatch opens upward, and often times, crashes directly into the garage door arm.

The resulting damage may include scratches, dents, removal of paint, shattering of rear windows, damage to the rear wiper, destruction of radio antennae, just to name a few. Therefore, what is needed is a way to prevent this damage from occurring. Home remedies by "do-it-yourselfers" have included taping tube shaped foam water toys to portions of the garage door arm. This looks quite tacky as well as being only a temporary solution that does not last, in addition to robbing the youngsters of their aquatic accessories. Car manufacturers have included advancements in technology with the rear lift hatch to include automatic sensor driven opening, and even a vertical stop position in some makes/models. Unfortunately, stopping the rear lift hatch prior to its full travel position is not practical for removing large items out of the rear portion of the vehicle, and is only available in limited circumstances from only a handful of manufacturers. This also may not provide a practical solution as the minimum height may still be too high, or the feature may malfunction altogether.

Therefore, what is required is a system that will take into account the very real possibility that contact between the rear lift hatch of a vehicle and a garage door arm may occur, and soften that contact to a point where no damage occurs, and no unsightly, or costly marking is left behind.

What is also required is a long term solution, that is aesthetically pleasing, and will provide permanent peace of mind that an owner's vehicle will be protected and safe in its own garage.

BRIEF SUMMARY OF THE INVENTION

The present invention comprises a system for the protection of vehicles, namely for the rear lift hatch of a vehicle. More specifically, the present invention comprises non-marking protectors, either directly affixed to a garage door opener arm, or mounted upon an intermediate bracket, which in turn is affixed to the garage door opener arm. The non-marking protectors ensure that where the height of the rear lift hatch is such that contact would be made with the door arm portion of the garage door opener, contact will instead be made with the non-marking protectors, thereby preventing damage to the rear lift hatch, such as scratches, dents, and the like.

BRIEF DESCRIPTION OF THE DRAWINGS

These and other features, aspects and advantages of the present general inventive concept will become better understood with reference to the following description, appended claims and accompanying drawings where:

DETAILED DESCRIPTION OF THE PREFERRED EMBODIMENTS

Figure 1:
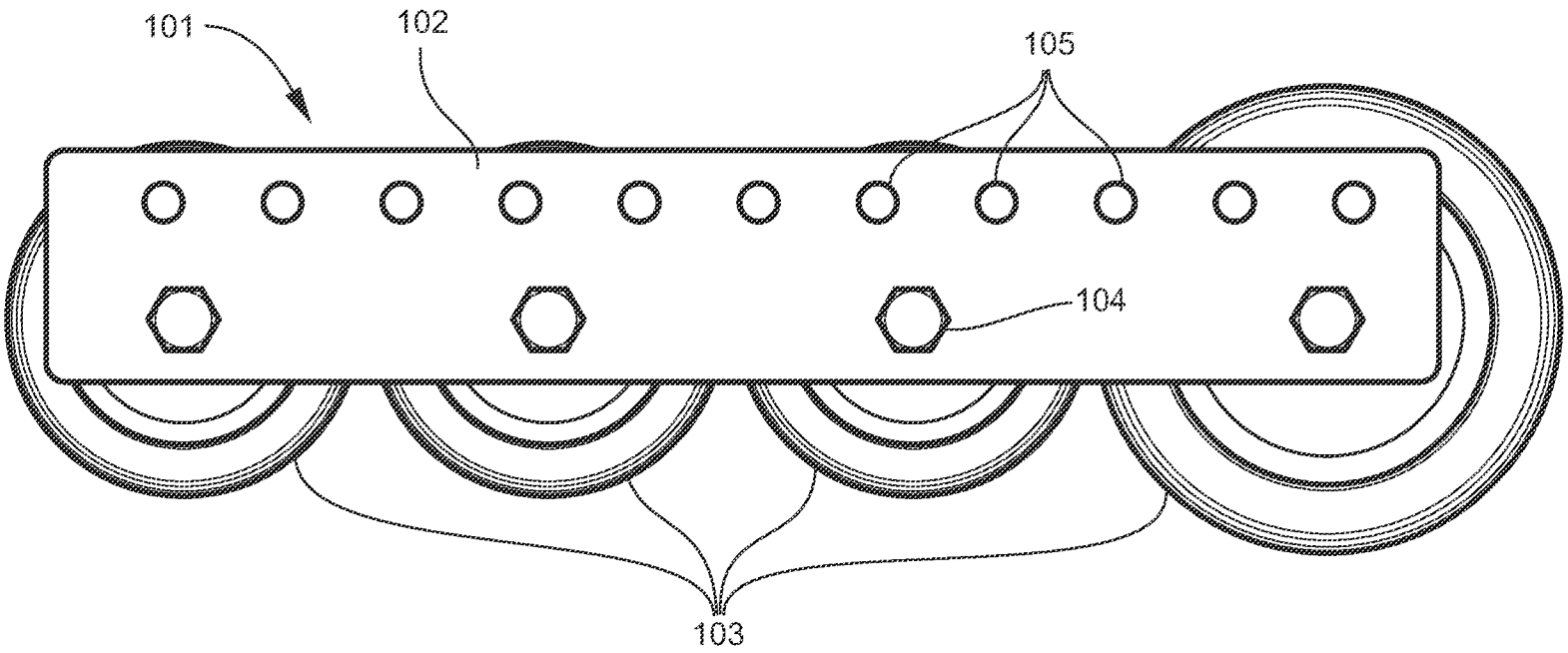
FIG. 1 is a side view of an embodiment of the present invention.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 illustrates a side view of the present invention 101. This embodiment includes mounting bracket 102, and non-marking protectors 103 attached to mounting bracket 102 by means of attachments 104. In a preferred embodiment this may be done with a bolt, washer and nut. Mounting bracket 102 may be attached to a garage door arm through portions noted as 105.

In a preferred embodiment, the system comprises at least one non-marking protector. As shown, the system further comprises three to four non-marking protectors, which in turn may comprise substantially circular objects, similar to wheels in shape and dimension. The exact number of non-marking protectors may vary, depending upon the size and location relative to the vehicle and door arm. The rounded shape of a wheel-like form may be preferable when considering its general purpose: i.e. making contact with a portion of a vehicle or the like. Other shapes, such as flat forms, may not rebound the way a rounded shape might, and the wheel-like form may roll and slide along the varying contours of a portion of a vehicle. Although one non-marking protector may be used, it is preferable to include more than one to allow for varying contact points that may occur between the system and a vehicle. Additionally, many factors come into play that may affect a contact point between the system and a vehicle portion such as vehicle height; vehicle lift hatch size, shape, and contour; garage door size; garage door opener configuration; and many others. Therefore, utilizing more than one non-marking protectors in this fashion will allow for all of these variables without worry or concern that a vehicle portion may contact any part of the garage door opener or assembly. It will also be clear to those skilled in the art, that the non-marking protectors need not be perfectly round, or even completely circular. In other words, if the likely contact portions of the non-marking protectors are suitable rounded, this may indeed serve its intended purpose and the top portions of the non-marking protectors, which likely make no contact with any vehicle portions, may be of any shape or dimension in alternate embodiments.

Figure 2:
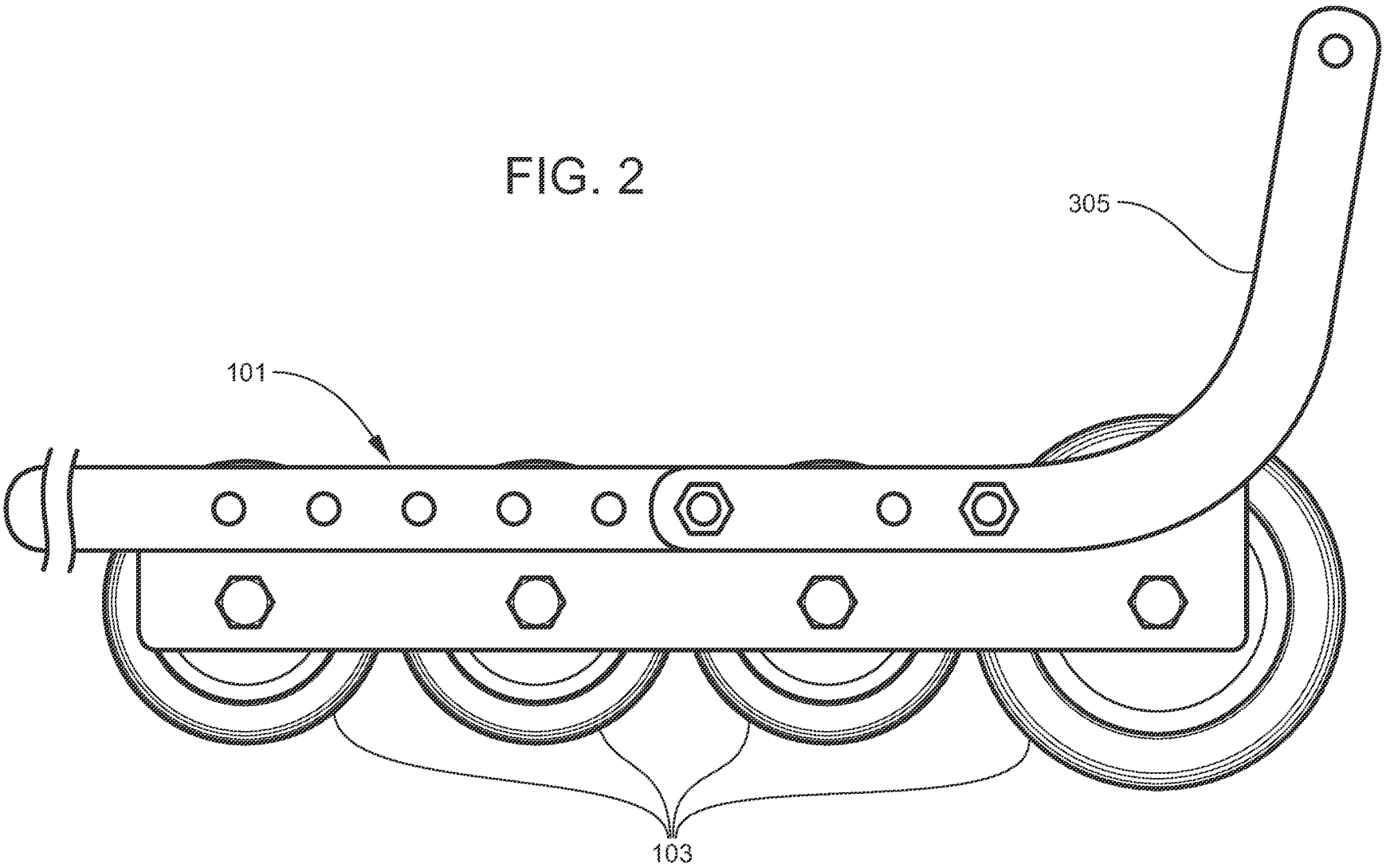
FIG. 2 is a side view of an embodiment of the present invention mounted on a garage door arm.

FIG. 2 depicts the present invention mounted upon the door arm of a garage door opener. Many garage door openers comprise two-piece doors arms; one straight, and one curved 305. The invention 101 is easily adaptable to attach to either portion, though preferably, it will attach to the straight portion as this will allow for the appropriate alignment between contact points of the rear lift hatch and non-marking protectors. Note that three non-marking protectors are shown in FIG. 2, with the first being larger than the remaining two. As noted, this may prevent damage to wiper arms, antennae, and other accessories.

Figure 3:
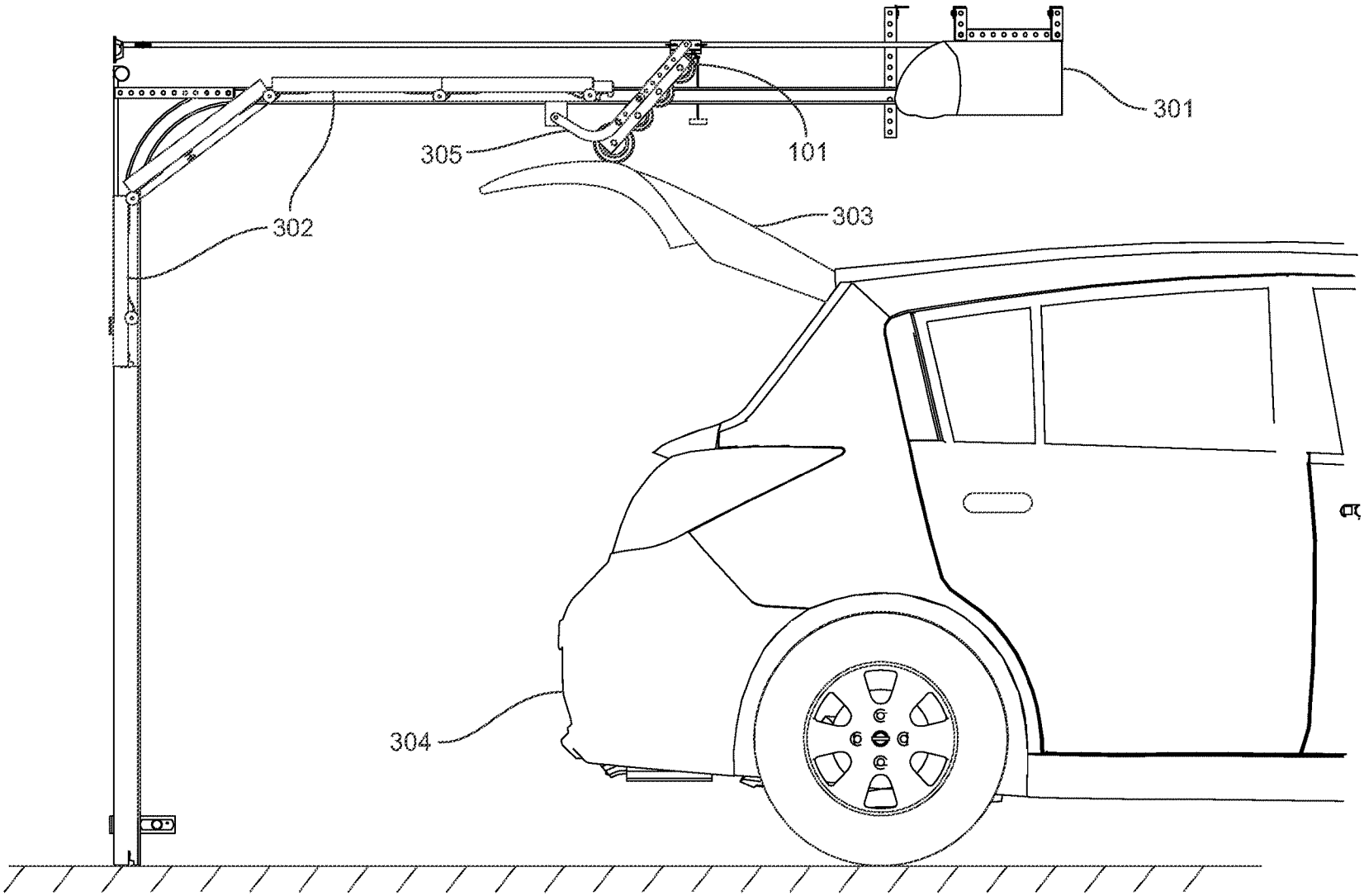
FIG. 3 is a side view of the present invention mounted and making contact with the rear lift gate of a vehicle.

FIG. 3 depicts the present invention 101 in action as a vehicle 304 has been housed within a garage, the garage door opener 301 has raised the garage door 302 to its open position, and the rear lift hatch 303 has been opened. Where damaging contact would have been made between the rear lift hatch and the garage door arm 305, instead the non-marking protectors have prevented any damage from occurring.

The at least one non-marking protector or protectors may comprise four said non-marking protectors to further allow for varying contours and shapes of vehicle portions which they may come into contact with. The first non-marking protector may be larger in circumference wherein a circular shape is used. This increase in size of a first non-marking protector may take into account rear window wiper arms, lift hatch handles and the like. Additionally, including more than one non-marking protector takes into account what may happen as a vehicle lift hatch is opened. For example, when a vehicle has entered an enclosure, such as a garage, and the garage door has been opened by means of an electric garage door opener, the vehicle lift hatch typically swings upward in an arcing motion. Therefore, if the vehicle lift hatch were to make contact with any portion of the garage door assembly, it would instead contact a portion of the system of the present invention.

Those skilled in the art will no doubt appreciate that the contacting vehicle portion will likely not raise and come to a complete stop immediately upon first contact, rather it may continue arcing upward and include vertical as well as horizontal vectors of movement. The addition of multiple non-marking protectors takes into consideration this movement and thereby prevents damage that might have otherwise occurred.

The non-marking protector, or protectors, themselves preferably comprise a non-marking material, as their name implies. This may be in the form of a rubber or plastic material, as is commonly known in the art. Color is not critical, though it is preferable to have the non-marking protectors fit aesthetically with the general decor of the garage, garage door assembly and/or garage door opener and related components. Where color additions may impede the non-marking properties of the non-marking protectors, it is preferable that they be white, or substantially clear and/or opaque in nature. Other materials may of course be utilized, such as woods and other biological compounds and composites. It may be advantageous to utilize recycled components to further reduce manufacture costs and the like. It shall be noted that a non-marking quality is preferably maintained regardless of the materials chosen. This is important when considering that the purpose of the non-marking protectors is indeed to prevent scratching, denting, marking or otherwise marring a vehicle portion that makes contact with the same.

The non-marking protectors may comprise a material that includes elasticity as well as the capability to allow for some deformation upon making contact with a vehicle lift gate. This would further decrease any chance that the vehicle lift gate may experience denting or other undesired deformation or damage of any kind.

Figure 4:
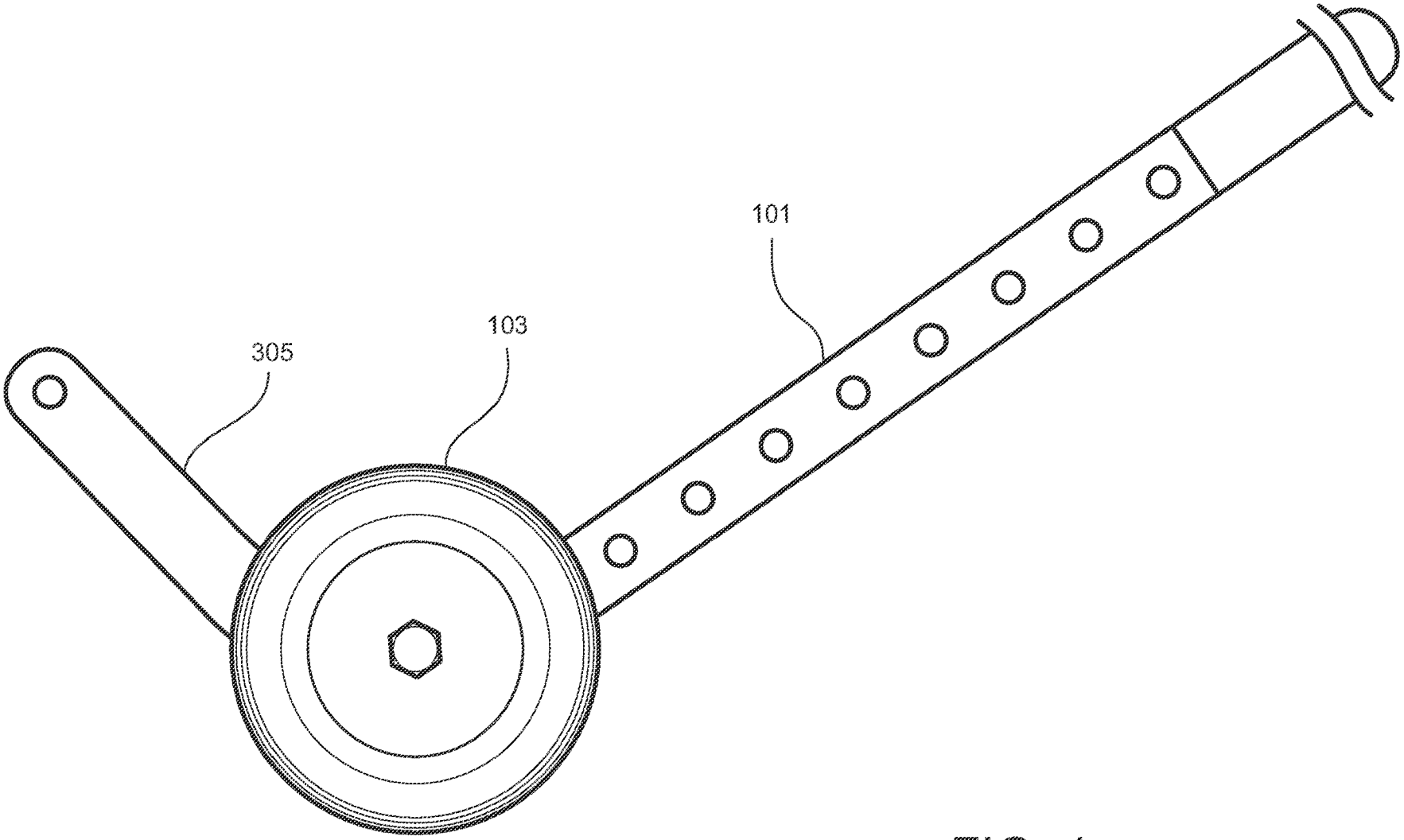
FIG. 4 is a side view of an alternate embodiment of the present invention.

FIG. 4 illustrates an alternate embodiment wherein a single non-marking protector may be utilized.

Figure 5:
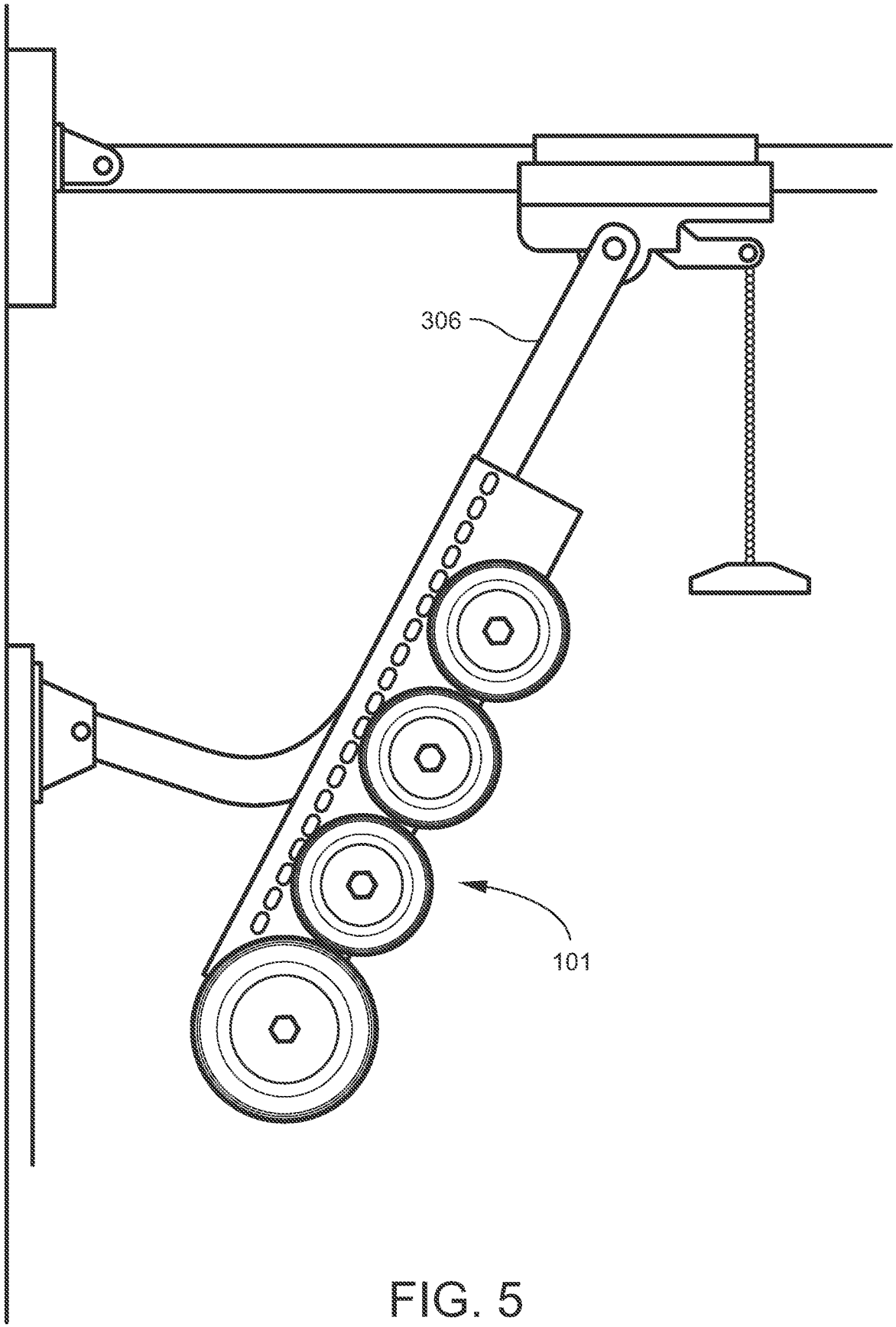
FIG. 5 is a side view of an embodiment of the present invention wherein the straight door arm components extends below the curved door arm component.

FIG. 5 illustrates the occasion wherein the straight arm portion of a garage door arm 306 extends past curved door arm portion 305. In this case, the owner may decide to cut a portion of the straight door arm 306 off, or simply utilize the versatility of the present invention by locating it further down the straight door arm 306 section. Contact will likely be made more quickly, but the damage will still be prevented. These types of garage door arms are clearly in greater need of the preventive aspects of the present invention, while at the same time it further illustrates how a temporary foam swim tube will not properly protect the vehicle.

Figure 6:
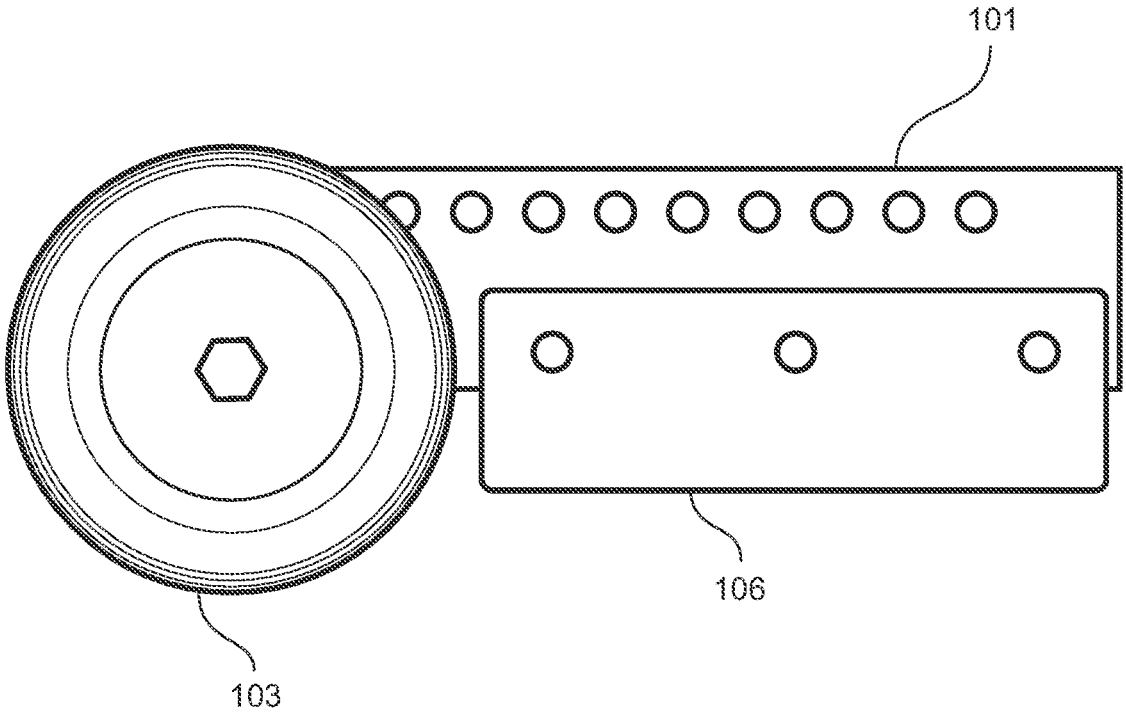
FIG. 6 is a side view of an alternate embodiment wherein a second non-marking protector comprises a sleeve.

FIG. 6 illustrates an embodiment wherein a first non-marking protector comprises a shape similar to a wheel or torus (a surface of revolution generated by revolving a circle in three-dimensional space about a coplanar axis), and a second non-marking protector comprises a rectangular portion. This rectangular piece may be attached via bolts or similar fasteners, or may be of sleeve-like construction that snaps up and over the garage door arm. The door arm could also be inserted into a sleeve portion and thereby completely cover the door arm. The sleeve 106 in any of these alternate embodiments could used with or without any additional torus-shaped non-marking protectors.

This design also flows naturally to the idea of a garage door arm that comprises a non-marking material similar to that of the non-marking protectors. The garage door arm would therefore retard impacts with the rear lift hatch, and prevent both marking and damage. The door arm would need to also comprise material that is strong enough to meet the demands associated with the opening and closing of the garage door.

In an alternative embodiment, the garage door arm may comprise its normal material (i.e. metal), but may then be dipped, or otherwise coated, in a non-marking material. This allows for the garage door arm to maintain the strength necessary for garage door opener functions, while preventing marking and damage to the rear lift hatch.

It is to be understood that the foregoing illustrative exemplary embodiments have been provided merely for the purpose of explanation and are in no way to be construed as limiting of the present general inventive concept. Words used herein are words of description and illustration, rather than words of limitation. In addition, the advantages and objectives described herein may not be realized by each and every exemplary embodiment practicing the present general inventive concept. Further, although the present general inventive concept has been described herein with reference to particular structure, steps and/or exemplary embodiments, the present general inventive concept is not intended to be limited to the particulars disclosed herein. Rather, the present general inventive concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the present general inventive concept.

What is claimed is:

1. A vehicle protection system comprising:

a door arm mounting bracket for attachment to a garage door arm of a garage door opener;

door arm mounting members for mounting said door arm mounting bracket to the garage door arm; and at least three non-marking protectors attached to said door arm mounting bracket, wherein said at least three non-marking protector comprises a non-marking material, and wherein said three non-marking protectors comprise a substantially torus shape, and wherein said three non-marking protectors further comprise a first non-marking protector, a second non-marking protector and a third non-marking protector and wherein said first non-marking protector comprises a size greater than that of said second non-marking protector and said third non-marking protector.

2. A vehicle protection system comprising:

a vehicle housing large enough to house a desired vehicle, wherein said vehicle housing comprises a garage and wherein said garage includes a bay and a garage door;

a garage door opener, wherein said garage door opener comprises a motor, tracks, trolley, and a door arm; and at least one non-marking protector, wherein said at least one non-marking protector is attached to said door arm wherein said at least one non-marking protector comprises a non-marking material and wherein said at least one non-marking protector comprises a sleeve, wherein said sleeve at least partially encapsulates said door arm.

* * * * *